United States Patent [19]

Heimerl et al.

[11] 4,209,421

[45] Jun. 24, 1980

[54] METHOD OF PREPARING BODIES CONTAINING RADIOACTIVE SUBSTANCES

[75] Inventors: Wilfried Heimerl, Julich; Edwin Schiewer; Amal K. Dé, both of Berlin, all of Fed. Rep. of Germany

[73] Assignee: Gelsenberg Aktiengesellschaft, Essen, Fed. Rep. of Germany

[21] Appl. No.: 872,279

[22] Filed: Jan. 25, 1978

[30] Foreign Application Priority Data

Feb. 2, 1977 [DE] Fed. Rep. of Germany ..... 2704147

[51] Int. Cl.[2] ..... G21F 9/28

[52] U.S. Cl. ..... 252/301.1 W; 65/33; 106/39.6; 106/39.7; 106/73.6; 428/406

[58] Field of Search ..... 252/301.1 W; 65/33; 106/39.6, 39.7, 73.6; 427/217; 428/406

[56] References Cited

U.S. PATENT DOCUMENTS 3,809,543 5/1974 Gaskell et al. ..... 65/33

FOREIGN PATENT DOCUMENTS 2524169 12/1976 Fed. Rep. of Germany .

OTHER PUBLICATIONS

Luckscheiter et al., "Fixation of Fission Products in Glass Ceramics", *Management of Radioactive Wastes From the Nuclear Fuel Cycle,* IAEA, Vienna, 1976, vol. II, pp. 63–73.

*Primary Examiner*—Benjamin R. Padgett
*Assistant Examiner*—Deborah L. Kyle
*Attorney, Agent, or Firm*—Sprung, Felfe, Horn, Lynch & Kramer

[57] ABSTRACT

Radioactive substances are disposed of by incorporating glass particles containing the radioactive substance in molten metal, heat treating the molten metal containing the glass particles to convert the glass to glass ceramic, and cooling the resulting composite to solidify the metal and provide the glass ceramic particles embedded in a matrix of the metal.

5 Claims, No Drawings

METHOD OF PREPARING BODIES CONTAINING RADIOACTIVE SUBSTANCES

BACKGROUND

For the safe final disposal of highly radioactive wastes, it is known to add glass formers to them and, by known methods, to melt a glass therefrom which, after solidification, can be stored in the form of monolithic glass blocks in an appropriate container. Furthermore, products of extra safety margin have been developed, such as aggregates of glass and metal, in which the highly radio-active glass in the form of particles, which may be of sizes between two and eight millimeters, is embedded in a metal matrix (W. Heimerl, *Atomwirtschaft-Atomtechnik,* 20 (1975) pp. 347–349). In other methods, the highly radioactive glass block of appropriate composition is subjected to a controlled devitrification by a suitable heat treatment; examples of the kind of glass ceramics which have been proposed for formation by this method are those of the celsian, perowskite, diopside and eucryptite type (A.K. De, B. Luckscheiter, W. Lutze, G. Malow, E. Schwiewer, S. Tymochowicz, *Management of Radioactive Wastes from the Nuclear Fuel Cycle,* IAEA, Vienna 1976, Vol. II, pp. 63–73).

THE INVENTION

The present invention concerns a method of making bodies which contain radioactive substances and which comprise a glass ceramic embedded in a metal matrix. In accordance with the invention, the glass, which is made in particle form in a known manner (e.g., German Offenlegungsschrift No. 24 53 404), is transformed by heat treatment in a metal bath to a glass ceramic.

For this purpose, the glass particles, whose composition is adjusted to the desired glass ceramic, are placed in a molten metal which is contained in a suitable vessel. In particular, the vessel for this purpose can be one in which glass ceramic and metal conglomerate will ultimately be stored, since in this case there will be no need to transfer an intermediate product or the end product to another container.

It is also, of course, possible to place the glass particles in the heat treatment vessel and then fill the interstices with molten metal. In this case the metal can also be put into the heat treatment vessel in solid form, e.g., in the form of scraps or rods, and can then be melted. In any case, a packing of virtually maximum density of the glass particles is achieved, in which the interstitial volume is completely filled with the molten metal or metal alloy.

Suitable metals are lead and its alloys or aluminum and its alloys.

The glass particles embedded in the molten metal are then subjected to a suitable heat treatment program. Since the incorporation of the particles into the molten metal is performed as a rule at the lowest possible temperature, the temperature is at first raised and sustained at a relatively high level.

If the composition of the glass particles is suitable, this heat treatment initiates a controlled devitrification, in which a glass ceramic product is formed from the glass. After the ceramization is completed, the molten metal and the glass ceramic contained in it are cooled. The embedding of the particles in metal and their ceramization are thus accomplished in a single step; if the ultimate container is used for the heat treatment as mentioned above, the end product is obtained without further manipulation.

The method of the invention has the advantage over the heat treatment of a monolithic glass block that, as a result of the smaller dimensions of the glass particles, their wall temperatures and internal temperatures are nearer one another, so that the heat treatment is easier to accomplish. If the glass particles should be brought to devitrification before incorporation into the melt, additional difficulties would be created on the one hand by the formation of high temperature gradients in the mass of particles on account of their poor heat conductivity, and on the other hand by the cohesion of particles which would make it difficult or impossible to transfer them to the end product vessel. In the method of the invention, however, cohesion of the particles due to softening of the glass does not occur.

EXAMPLE 100 grams of lenticular borosilicate particles (composition 35 wt.-% $SiO_2$, 16% $Al_2O_3$, 8% $B_2O_3$, 2% $Na_2O$, 3% $Li_2O$, 5% CaO, 1.5% MgO, 18.5% BaO, 1% $ZrO_2$, 5% $TiO_2$, 4.5% ZnO, 0.5% $As_2O_3$, plus 20% of fission product oxides) having a diameter of 4 to 5 mm were introduced into 25 ml of molten pure lead of a temperature of approximately 400° C. Then the temperature was raised to 800° C. and maintained at this level for twelve hours. Then the furnace was shut off and allowed to cool. The end product was an aggregate of borosilicate glass ceramic and lead.

What we claim is:

1. Process of providing radioactive substance in a form suitable for disposal of the radioactive substance, comprising incorporating glass particles containing said radioactive substance in molten metal so that the particles are embedded in the molten metal, the glass of said glass particles being suitable for conversion to glass ceramic, and heat treating the molten metal having the glass particles embedded therein to convert the glass of the glass particles to glass ceramic and provide glass ceramic particles containing the radioactive substance embedded in a metal matrix.

2. Process of claim 1, wherein, in said heat treatment, the temperature of the molten metal is first increased, then maintained at increased temperature for a time period, and is then reduced to provide glass ceramic particles embedded in solidified metal matrix.

3. Process of claim 1, wherein the molten metal in which the glass particles are incorporated is in a container, the heat treatment is performed with the glass particles and metal in the container, and the glass ceramic particles embedded in the metal matrix is formed in the container, and the container containing the ceramic particles embedded in the metal matrix is stored for disposal.

4. Process of claim 2, wherein the molten metal in which the glass particles are incorporated is in a container, the heat treatment is performed with the glass particles and metal in the container, and the glass ceramic particles embedded in the metal matrix is formed in the container, and the container containing the ceramic particles embedded in the metal matrix is stored for disposal.

5. Process of claim 1, wherein the metal is of the group lead, lead alloys, aluminum, and aluminum alloys.

* * * * *

UNITED STATES PATENT AND TRADEMARK OFFICE

CERTIFICATE OF CORRECTION

PATENT NO. : 4,209,421

DATED : June 24, 1980

INVENTOR(S) : Wilfried Heimerl et al

It is certified that error appears in the above—identified patent and that said Letters Patent is hereby corrected as shown below:

On the title page, Assignee should read

-- Deutsche Gesellschaft für Wiederaufarbeitung von Kernbrennstoffen mit beschränkter Haftung, Hanover, Germany --, Signed and Sealed this

*Twenty-second* Day of *June 1982*

[SEAL]

*Attest:*

GERALD J. MOSSINGHOFF

*Attesting Officer*

*Commissioner of Patents and Trademarks*